US009402141B2

(12) United States Patent
Kvist

(10) Patent No.: US 9,402,141 B2
(45) **Date of Patent: *Jul. 26, 2016**

(54) BTE HEARING AID WITH AN ANTENNA PARTITION PLANE

(71) Applicant: GN ReSound A/S, Ballerup (DK)

(72) Inventor: Soren Kvist, Vaerlose (DK)

(73) Assignee: GN RESOUND A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 13/931,556

(22) Filed: Jun. 28, 2013

(65) Prior Publication Data

US 2014/0010394 A1 Jan. 9, 2014

(30) Foreign Application Priority Data

Jul. 6, 2012 (DK) ..... 2012 70410

(51) Int. Cl.
*H04R 25/00* (2006.01)
*H01Q 9/24* (2006.01)
*H01Q 1/42* (2006.01)

(52) U.S. Cl.
CPC ..... *H04R 25/554* (2013.01); *H01Q 9/24* (2013.01); *H01Q 1/42* (2013.01); *H04R 25/558* (2013.01); *H04R 2225/021* (2013.01); *H04R 2225/51* (2013.01)

(58) Field of Classification Search
CPC ..... H04R 25/554; H04R 2225/021; H04R 2225/51; H01A 1/42
USPC ..... 381/315, 322, 324, 331; 343/725, 726, 343/727, 728, 749, 872
See application file for complete search history.

(56) References Cited

U.S. PATENT DOCUMENTS

| | | | |
|---|---|---|---|
| 2,535,063 | A | 12/1950 | Halstead |
| 3,276,028 | A | 9/1966 | Mayes et al. |
| 4,334,315 | A | 6/1982 | Ono et al. |
| 4,652,888 | A | 3/1987 | Deasy |
| 4,924,237 | A | 5/1990 | Honda et al. |

(Continued)

FOREIGN PATENT DOCUMENTS

| | | | |
|---|---|---|---|
| CN | 1684549 | A | 10/2005 |
| CN | 101835082 | A | 9/2010 |

(Continued)

OTHER PUBLICATIONS

Final Office Action dated Feb. 27, 2014, for U.S. Appl. No. 13/271,180.

(Continued)

*Primary Examiner* — Jesse Elbin
(74) *Attorney, Agent, or Firm* — Vista IP Law Group, LLP

(57) ABSTRACT

A behind the ear (BTE) hearing aid includes: a microphone; a signal processor; a receiver; a partition plane extending between a first side of the hearing aid and a second side of the hearing aid; and a transceiver for wireless data communication interconnected with an antenna for electromagnetic field emission and electromagnetic field reception, the antenna having a first feed point and a second feed point; wherein at least a part of the antenna intersects the partition plane at an intersection so that a relative difference between a first distance from the first feed point to the intersection and a second distance from the second feed point to the intersection is less than or equal a first threshold.

38 Claims, 8 Drawing Sheets

(56) References Cited

U.S. PATENT DOCUMENTS

| | | | | |
|---|---|---|---|---|
| 5,621,422 | A | 4/1997 | Wang | |
| 5,721,783 | A | 2/1998 | Anderson | |
| 5,760,746 | A | 6/1998 | Kawahata | |
| 5,761,319 | A | 6/1998 | Dar et al. | |
| 6,161,036 | A | 12/2000 | Matsumura | |
| 6,515,629 | B1 | 2/2003 | Kuo | |
| 7,002,521 | B2 | 2/2006 | Ishibana et al. | |
| 7,154,442 | B2 | 12/2006 | Van Wonterghem et al. | |
| 7,256,747 | B2 * | 8/2007 | Victorian et al. | 343/718 |
| 7,446,708 | B1 | 11/2008 | Nguyen et al. | |
| 7,570,777 | B1 | 8/2009 | Taenzer et al. | |
| 7,593,538 | B2 | 9/2009 | Polinske | |
| 7,652,628 | B2 | 1/2010 | Zweers | |
| 7,791,551 | B2 | 9/2010 | Platz | |
| 7,978,141 | B2 | 7/2011 | Chi et al. | |
| 8,494,197 | B2 | 7/2013 | Polinske et al. | |
| 2004/0080457 | A1 | 4/2004 | Guo | |
| 2004/0246179 | A1 | 12/2004 | Chen et al. | |
| 2005/0068234 | A1 | 3/2005 | Hung et al. | |
| 2005/0094840 | A1 | 5/2005 | Harano | |
| 2005/0099341 | A1 | 5/2005 | Zhang et al. | |
| 2005/0244024 | A1 | 11/2005 | Fischer et al. | |
| 2005/0248717 | A1 | 11/2005 | Howell et al. | |
| 2006/0012524 | A1 | 1/2006 | Mierke et al. | |
| 2006/0018496 | A1 | 1/2006 | Niederdrank et al. | |
| 2006/0061512 | A1 * | 3/2006 | Asano et al. | 343/702 |
| 2006/0071869 | A1 | 4/2006 | Yoshino et al. | |
| 2006/0115103 | A1 | 6/2006 | Feng | |
| 2006/0181466 | A1 | 8/2006 | Krupa | |
| 2006/0192723 | A1 | 8/2006 | Harada et al. | |
| 2007/0080889 | A1 | 4/2007 | Zhang | |
| 2007/0171134 | A1 | 7/2007 | Yoshino et al. | |
| 2007/0229369 | A1 | 10/2007 | Platz | |
| 2007/0229376 | A1 | 10/2007 | Desclos et al. | |
| 2007/0230714 | A1 | 10/2007 | Armstrong | |
| 2007/0285321 | A1 | 12/2007 | Chung | |
| 2008/0024375 | A1 | 1/2008 | Martin et al. | |
| 2008/0056520 | A1 * | 3/2008 | Christensen et al. | 381/323 |
| 2008/0079645 | A1 | 4/2008 | Higasa et al. | |
| 2008/0231524 | A1 | 9/2008 | Zeiger et al. | |
| 2009/0074221 | A1 | 3/2009 | Westermann | |
| 2009/0169038 | A1 | 7/2009 | Knudsen et al. | |
| 2009/0196444 | A1 | 8/2009 | Solum | |
| 2009/0231204 | A1 | 9/2009 | Shaker et al. | |
| 2009/0231211 | A1 | 9/2009 | Zweers | |
| 2009/0243944 | A1 | 10/2009 | Jung et al. | |
| 2009/0273530 | A1 | 11/2009 | Chi et al. | |
| 2009/0315787 | A1 | 12/2009 | Schatzle | |
| 2010/0020994 | A1 | 1/2010 | Christensen et al. | |
| 2010/0033380 | A1 | 2/2010 | Pascolini et al. | |
| 2010/0109953 | A1 | 5/2010 | Tang | |
| 2010/0158291 | A1 | 6/2010 | Polinske et al. | |
| 2010/0158293 | A1 | 6/2010 | Polinske et al. | |
| 2010/0158295 | A1 | 6/2010 | Polinske et al. | |
| 2010/0172525 | A1 | 7/2010 | Angst et al. | |
| 2010/0245201 | A1 | 9/2010 | Hossain et al. | |
| 2010/0321269 | A1 | 12/2010 | Ishibana et al. | |
| 2011/0007927 | A1 | 1/2011 | Hedrick et al. | |
| 2011/0022121 | A1 | 1/2011 | Meskins | |
| 2011/0129094 | A1 | 6/2011 | Petersen | |
| 2011/0294537 | A1 | 12/2011 | Vance | |
| 2012/0087506 | A1 | 4/2012 | Ozden | |
| 2012/0093324 | A1 | 4/2012 | Sinasi | |
| 2012/0154222 | A1 | 6/2012 | Oh et al. | |
| 2013/0308805 | A1 * | 11/2013 | Ozden, Sinasi | 381/315 |
| 2014/0010392 | A1 | 1/2014 | Kvist | |
| 2014/0185848 | A1 | 7/2014 | Ozden et al. | |
| 2014/0321685 | A1 * | 10/2014 | Rabel | 381/324 |

FOREIGN PATENT DOCUMENTS

| | | | |
|---|---|---|---|
| DE | 3625891 | A1 | 2/1988 |
| DE | 10 2004 017832 | | 10/2005 |
| DE | 10 2008 022 127 | A1 | 11/2009 |
| EP | 1 231 819 | A2 | 8/2002 |
| EP | 1294049 | A1 | 3/2003 |
| EP | 1 465 457 | A2 | 10/2004 |
| EP | 1 465 457 | A3 | 10/2004 |
| EP | 1 589 609 | A2 | 10/2005 |
| EP | 1 594 188 | A1 | 11/2005 |
| EP | 1 681 903 | A2 | 7/2006 |
| EP | 1 763 145 | A1 | 3/2007 |
| EP | 1939984 | A1 | 2/2008 |
| EP | 1 953 934 | A1 | 8/2008 |
| EP | 2 200 120 | A2 | 6/2010 |
| EP | 2 200 120 | A3 | 6/2010 |
| EP | 2 207 238 | A1 | 7/2010 |
| EP | 2 229 009 | A1 | 9/2010 |
| EP | 2 302 737 | | 3/2011 |
| EP | 2 458 674 | A2 | 5/2012 |
| EP | 2637251 | A1 | 11/2013 |
| EP | 2 680 366 | | 1/2014 |
| EP | 2 723 101 | A2 | 4/2014 |
| EP | 2 723 101 | A3 | 4/2014 |
| EP | 2 765 650 | | 8/2014 |
| JP | S59-97204 | | 6/1984 |
| JP | H10-209739 | | 8/1998 |
| JP | 2005-304038 | A | 10/2005 |
| JP | 2006025392 | | 1/2006 |
| JP | 2006-033853 | A | 2/2006 |
| JP | 2012-090266 | | 5/2012 |
| WO | WO 98/44762 | | 10/1998 |
| WO | WO 0199226 | A1 | 12/2001 |
| WO | WO 03/026342 | | 3/2003 |
| WO | WO 2004/110099 | A2 | 12/2004 |
| WO | WO 2005/076407 | A2 | 8/2005 |
| WO | 2005/081583 | A1 | 9/2005 |
| WO | WO 2006/055884 | A2 | 5/2006 |
| WO | 2006122836 | A2 | 11/2006 |
| WO | WO 2007/045254 | A1 | 4/2007 |
| WO | WO 2007/140403 | A2 | 6/2007 |
| WO | 2008012355 | A1 | 1/2008 |
| WO | WO 2009/010724 | A1 | 1/2009 |
| WO | 2009/098858 | A1 | 8/2009 |
| WO | WO 2009/098858 | A1 | 8/2009 |
| WO | WO 2009/117778 | A1 | 10/2009 |
| WO | WO 2010/065356 | A1 | 6/2010 |
| WO | WO 2011099226 | | 8/2011 |
| WO | WO 2012059302 | A2 | 5/2012 |
| WO | WO 2014/090420 | A1 | 6/2014 |

OTHER PUBLICATIONS

Extended European Search Report dated Mar. 7, 2014 for EP Patent Application No. 11184507.9.

Final Office Action dated May 19, 2014 for U.S. Appl. No. 13/740,471.

Non-Final Office Action dated Mar. 27, 2014 for U.S. Appl. No. 13/848,605.

Extended European Search Report dated Mar. 7, 2014 for EP Patent Application No. 11184503.8.

Extended European Search Report dated May 6, 2014 for EP Patent Application No. 13175258.6.

Extended European Search Report dated Apr. 17, 2014 for EP Patent Application No. 13192316.1.

Extended European Search Report dated Apr. 22, 2014 for EP Patent Application No. 13192323.7.

Non-Final Office Action dated May 22, 2014 for U.S. Appl. No. 13/271,170.

Second Danish Office Action dated Apr. 24, 2012 for Danish Patent Application No. PA 2010 00931.

First Danish Office Action dated Apr. 26, 2011 for Danish Patent Application No. PA 2010 00931.

Danish Office Action dated Apr. 30, 2012 for Danish Patent Application No. PA 2011 70566.

Danish Office Action dated May 1, 2012 for Danish Patent Application No. PA 2011 70567.

Third Danish Office Action dated Oct. 17, 2012 for Danish Patent Application No. PA 2010 00931.

First Office Action dated Feb. 12, 2013 for Japanese Patent Application No. 2011-224711.

(56) References Cited

OTHER PUBLICATIONS

Fourth Danish Office Action , Intention to Grant dated Feb. 13, 2013 for Danish Patent Application No. PA 2010 00931.
Notice of Reasons for Rejection dated May 21, 2013 for Japanese Patent Application No. 2011-224705.
Non-final Office Action dated Oct. 8, 2013 for U.S. Appl. No. 13/271,180.
Chinese Office Action and Search Report dated Nov. 12, 2013 for related CN Patent Application No. 201110317264.6.
Chinese Office Action and Search Report dated Dec. 4, 2013 for related CN Patent Application No. 201110317229.4.
1st Technical Examination and Search Report dated Jan. 25, 2013 for DK Patent Application No. PA 2012 70412, 4 pages.
1st Technical Examination and Search Report dated Jan. 24, 2013 for DK Patent Application No. PA 2012 70411, 5 pages.
Second Technical Examination dated Aug. 6, 2013 for DK Patent Application No. PA 2012 70411, 2 pages.
Second Technical Examination—Intention to Grant dated Jul. 8, 2013 for DK Patent Application No. PA 2012 70412, 2 pages.
Non-final Office Action dated Jan. 2, 2014 for U.S. Appl. No. 13/740,471.
First Technical Examination and Search Report Dated Jan. 18, 2013 for DK Patent Application No. PA 2012 70410, 4 pages.
Second Technical Examination dated Jul. 12, 2013, for DK Patent Application No. PA 2012 70410, 2 pages.
Third Technical Examination dated Jan. 31, 2014, for DK Patent Application No. PA 2012 70410, 2 pages.
Advisory Action dated Aug. 29, 2014 for U.S. Appl. No. 13/740,471.
Extended European Search Report dated May 14, 2014 for EP Patent Application No. 13192322.9.
Final Office Action dated Aug. 29, 2014 for U.S. Appl. No. 13/848,605.
First Technical Examination and Search Report dated Jun. 26, 2014 for DK Patent Application No. PA 2013 70667, 5 pages.
Non-Final Office Action dated Jul. 29, 2014 for U.S. Appl. No. 13/917,448.
Office Action dated Jun. 17, 2014 in Japanese Patent Application No. 2013-258396, 3 pages.
First Technical Examination dated Jun. 25, 2014 for DK Patent Application No. PA 2013 70665, 5 pages.
First Technical Examination dated Jun. 26, 2014 for DK Patent Application No. PA 201370664, 5 pages.
First Technical Examination and Search Report dated Jun. 27, 2014 for DK Patent Application No. PA 2013 70666, 5 pages.
Non-final Office Action dated Feb. 24, 2015 for U.S. Appl. No. 14/202,486.
Notice of Allowance dated Mar. 5, 2015 for U.S. Appl. No. 13/917,448.
Non-final Office Action dated Nov. 18, 2014 for U.S. Appl. No. 13/271,180.
Conway et al., Antennas for Over-Body-Surface Communication at 2.45 GHz, Apr. 2009, IEEE Transactions on Antennas and Propagation, vol. 57, No. 4, pp. 844-855.
Non-final Office Action dated Dec. 18, 2014 for U.S. Appl. No. 13/740,471.
Final Office Action dated Dec. 31, 2014 for U.S. Appl. No. 13/271,170.
Non-final Office Action dated Jan. 5, 2015 for U.S. Appl. No. 13/848,605.
Extended European Search Report dated Oct. 9, 2014 for EP Patent Application No. 14181165.3.
Examiner Bengtsson, Rune, "Novelty Search including a Preliminary Patentability Opinion Report", in reference to P81007295DK02, dated Jul. 28, 2011 (8 pages).
Examiner Bengtsson, Rune, "Novelty Search including a Preliminary Patentability Opinion Report", in reference to P81101358DK01, dated Jul. 28, 2011 (8 pages).
Non-final Office Action dated Jan. 15, 2015 for U.S. Appl. No. 14/199,511.
Non-final Office Action dated Feb. 5, 2015 for U.S. Appl. No. 14/198,396.
Non-final Office Action dated Jun. 10, 2015 for U.S. Appl. No. 14/199,263.
Notice of Allowance and Fee(s) Due dated Jun. 18, 2015, for U.S. Appl. No. 13/917,448.
Communication pursuant to Article 94(3) EPC dated Mar. 16, 2015, for related European Patent Application No. 11 184 503.8, 12 pages.
Communication pursuant to Article 94(3) EPC dated Mar. 19, 2015, for related European Patent Application No. 11 184 507.9, 12 pages.
Non-final Office Action dated Jul. 1, 2015 for U.S. Appl. No. 14/199,070.
First Technical Examination and Search Report dated Mar. 9, 2015, for related Danish Patent Application No. PA 2014 70489.
Non-final Office Action dated May 7, 2015 for U.S. Appl. No. 13/271,180.
Advisory Action dated May 14, 2015 for U.S. Appl. No. 13/271,170.
Notice of Allowance and Fee(s) Due dated May 22, 2015 for U.S. Appl. No. 13/848,605.
Final Office Action dated Jul. 15, 2015 for related U.S. Appl. No. 13/740,471.
Non-final Office Action dated Aug. 17, 2015 for related U.S. Appl. No. 14/198,396.
Non-final Office Action dated Aug. 25, 2015 for related U.S. Appl. No. 14/202,486.
Notice of Allowance and Fee(s) Due dated Sep. 2, 2015 for related U.S. Appl. No. 14/199,511.
Notice of Allowance and Fee(s) Due dated Sep. 3, 2015 for related U.S. Appl. No. 13/848,605.
Notice of Allowance and Fee(s) Due dated Sep. 25, 2015 for related U.S. Appl. No. 13/271,170.
Final Office Action dated Nov. 18, 2015 for related U.S. Appl. No. 14/199,263.
Non-final Office Action dated Dec. 2, 2015 for related U.S. Appl. No. 13/271,180.
Notice of Allowance and Fee(s) Due dated Dec. 18, 2015 for related U.S. Appl. No. 13/917,448.
Notification of Reasons for Rejection dated Nov. 24, 2015 for related Japanese Patent Application No. 2014-228343, 8 pages.
Notice of Allowance and Fee(s) Due dated Feb. 16, 2016 for related U.S. Appl. No. 13/740,471.
Advisory Action dated Feb. 1, 2016 for related U.S. Appl. No. 14/199,263.
Final Office Action dated Mar. 22, 2016 for related U.S. Appl. No. 14/202,486.
Notice of Allowance and Fee(s) due dated Mar. 23, 2016 for related U.S. Appl. No. 14/198,396.
Final Office Action dated Apr. 4, 2016 for related U.S. Appl. No. 13/271,180.
Final Office Action dated Apr. 15, 2016 for related U.S. Appl. No. 14/199,070.
Notice of Allowance dated May 25, 2016 for related U.S. Appl. No. 14/199,263.

* cited by examiner

BTE HEARING AID WITH AN ANTENNA PARTITION PLANE

RELATED APPLICATION DATA

This application claims priority to and the benefit of Danish Patent Application No. PA 2012 70410, filed on Jul. 6, 2012. The entire disclosure of the above-identified application is expressly incorporated by reference herein.

FIELD

The present disclosure relates to a hearing aid having an antenna, such as an antenna intersecting a hearing aid partition plane, the antenna being configured for providing the hearing aid with wireless data communication features.

BACKGROUND

Hearing aids are very small and delicate devices and comprise many electronic and metallic components contained in a housing small enough to fit in the ear canal of a human or behind the outer ear. The many electronic and metallic components in combination with the small size of the hearing aid housing impose high design constraints on radio frequency antennas to be used in hearing aids with wireless communication capabilities.

Conventionally, antennas in hearing aids have been used for receiving radio broadcasts or commands from a remote control. Typically, such antennas are designed to fit in the hearing aid housing without special concern with relation to the obtained directivity of the resulting radiation pattern. For example, behind-the-ear hearing aid housings typically accommodate antennas positioned with their longitudinal direction in parallel to the longitudinal direction of the banana shaped behind-the-ear hearing aid housing. In-the-ear hearing aids have typically been provided with patch antennas positioned on the face plate of the hearing aids as for example disclosed in WO 2005/081583; or wire antennas protruding outside the hearing aid housing in a direction perpendicular to the face plate as for example disclosed in US 2010/20994.

SUMMARY

It is an object to provide an improved wireless communication.

In one aspect, the above-mentioned and other objects are obtained by provision of a hearing aid, such as a behind the ear hearing aid, comprising a partition plane extending between a first side of the hearing aid and a second side of the hearing aid, a transceiver for wireless data communication interconnected with an antenna, such as an electric antenna, for emission and reception of an electromagnetic field. The antenna may have a first feed point and a second feed point. At least a part of the antenna may intersects the partition plane so that a relative difference between a first distance from the first feed point to the intersection and a second distance from the second feed point to the intersection is less than or equal a first threshold. The first feed point may be provided on a first side of the partition plane, and the second feed point may be provided on a second side of the partition plane.

The partition plane, may be a plane of intersection and may extend between the first side and the second side of the hearing aid. At least a part of the antenna may intersect the partition plane so that there is a first distance from the first feed point to the partition plane and a second distance from the second feed point to the partition plane. The first distance and the second distance may be substantially the same so that the first and second feed points are provided substantially symmetrically with respect to the partition plane. A relative difference between the first distance and the second distance may be less than or equal a first threshold, such as less the than 25%, such as less than 10%, such as about 0.

The partition plane may be any plane partitioning the hearing aid, such as a plane parallel to the first and/or second side of the hearing aid, such as a plane parallel to the side of a head when the hearing aid is worn in its operational position on the head of a user. The partition plane may form a symmetry plane for the antenna, so that for example the antenna is symmetric with respect to the partition plane.

The first distance and the second distance may be measured along a shortest path between the first feed point and the partition plane, and the second feed point and the partition plane, such that the distance is the shortest physical distance. Alternatively, the first distance and the second distance may be the distance as measured along a current path between the first or second feed point and the partition plane.

In one or more embodiments, a first part of the antenna may be located proximate the first side of the hearing aid and a second part of the antenna may be located proximate the second side of the hearing aid, i.e. on a first side of the partition plane and a second side of the partition plane, respectively.

A segment of the antenna may intersect the partition plane and the segment may short circuit the first part of the antenna and the second part of the antenna to provide a current bridge between the first side of the hearing aid and the second side of the hearing aid.

In one or more embodiments, the current induced in the segment may be symmetric with respect to a plane substantially partitioning the segment in the middle of the segment.

The segment may be provided in a position substantially orthogonal to a side of the head, when the hearing aid is worn by a user in its intended operational position. In one or more embodiments, the segment may extend in a direction having at least a vector component being orthogonal to the side of the head, for example the vector component being orthogonal to the side of the head may be at least the same length as a vector component extending parallel to the side of the head.

Hereby, an electromagnetic field emitted by the antenna may propagate along the surface of the head of the user with its electrical field substantially orthogonal to the surface of the head of the user when the hearing aid is worn in its operational position by a user.

Preferably, the electromagnetic field emitted by the antenna propagates primarily along the surface of the head or body of the user.

Upon excitation, a substantial part of the electromagnetic field, such as 60%, such as 80%, emitted by the antenna may propagate along the surface of the head of the user with its electrical field substantially orthogonal to the surface of the head of the user. When the electromagnetic field is diffracted around the head of a user, loses due to the interaction with the surface of the head are minimized. Hereby, a significantly improved reception of the electro-magnetic radiation by either a second hearing aid in a binaural hearing aid system, typically located at the other ear of a user, or by a hearing aid accessory, such as a remote control, a telephone, a television set, a spouse microphone, a hearing aid fitting system, an intermediary component, such as a Bluetooth bridging device, etc., is obtained.

In that the electromagnetic field is diffracted around the head, or the body, of a user with minimum interaction with the surface of the head, or the surface of the body, the strength of the electromagnetic field around the head, or the body, of the user is significantly improved. Thus, the interaction with other antennas and/or transceivers, as provided in either a second hearing aid of a binaural hearing aid system located at the other ear of a user, or as provided in accessories as mentioned above, which typically are located in front of a user, or other wearable computing devices, is enhanced. It is a further advantage of providing an electromagnetic field around the head of a user that an omni-directional connectivity to external devices, such as accessories, is provided.

Due to the current component normal to the side of the head or normal to any other body part, the surface wave of the electromagnetic field may be more efficiently excited. Hereby, for example an ear-to-ear path gain may be improved, such as by 10-15 dB, such as by 10-20 dB.

The antenna may emit a substantially TM polarized electromagnetic field for diffraction around the head of a user, i.e. TM polarised with respect to the surface of the head of a user.

It is an advantage that, during operation, the segment of the antenna contributes to an electromagnetic field that travels around the head of the user thereby providing a wireless data communication that is robust and has low loss.

In that the antenna does not, or substantially does not, emit an electromagnetic field in the direction of the segment, such as in a direction along a longitudinal direction of the segment, the antenna does not, or substantially does not, emit an electromagnetic field in the direction of the ear to ear axis of the user when the hearing aid is positioned in its operational position at the ear of the user; rather, the antenna emits an electromagnetic field that propagates in a direction parallel to the surface of the head of the user when the hearing aid is positioned in its operational position during use, whereby the electric field of the emitted electromagnetic field has a direction that is orthogonal to, or substantially orthogonal to, the surface of the head at least along the side of the head, or the part of the body, at which the antenna is positioned during operation. In this way, propagation loss in the tissue of the head is reduced as compared to propagation loss of an electromagnetic field with an electric field component that is parallel to the surface of the head. Diffraction around the head makes the electromagnetic field emitted by the antenna propagate from one ear and around the head to the opposite ear.

The hearing aid typically further comprises a microphone for reception of sound and conversion of the received sound into a corresponding first audio signal, a signal processor for processing the first audio signal into a second audio signal compensating a hearing loss of a user of the hearing aid, and a receiver that is connected to an output of the signal processor for converting the second audio signal into an output sound signal.

The segment may preferably be structured so that upon excitation of the antenna, the current flows in at least the segment in a direction substantially orthogonal to a surface of the head of a user when the hearing aid is worn in its operational position by the user. Thus, the segment may extend in a direction substantially parallel with an ear to ear axis of the user, and thus, substantially orthogonal to a surface of the head, when the hearing aid is worn in its operational position by a user.

In one or more embodiments, the first part of the antenna is substantially identical to the second part of the antenna. Thus, the physical shape of the first part of the antenna may be substantially identical to the physical shape of the second part of the antenna. Additionally, or alternatively, the first part of the antenna and the second part of the antenna may have substantially the same free-space antenna radiation pattern.

The first feed point may be configured to excite at least the first part of the antenna and the second feed point may be configured to excite at least the second part of the antenna.

The first part of the antenna and/or the second part of the antenna may be actively fed. Thus, the first part of the antenna may have a first feed point and the second part of the antenna may have a second feed point. In one or more embodiments, the first part of the antenna and the second part of the antenna may be fed from the transceiver in the hearing aid.

The first and second feed points may form part of a feed system, the feed system may furthermore comprise one or more transmission lines for connecting the first part of the antenna and the second part of the antenna to the source, such as to the radio or the transceiver. The first feed point and the second feed point may be initially balanced, that is out of phase. The first feed point may reflect the connection between a first transmission line and the first part of the antenna, and the second feed point may reflect the connection between another transmission line and the second part of the antenna.

The antenna may be a balanced antenna, and in one or more embodiments, the current from the transceiver to the first feed point and the current from the transceiver to the second feed point may thus have substantially the same magnitude but run in opposite directions, thereby establishing a balanced feed line and a balanced antenna. It is envisaged that the current magnitudes may not be exactly the same, so that some radiation, though principally unwanted, from the feed line may occur.

It is an advantage of using a balanced antenna that no ground plane is needed for the antenna. As the size of the hearing aids is constantly reduced, also the size of printed circuit boards within the hearing aids is reduced. This has been found to pose a challenge as conventional hearing aid antennas typically use the printed circuit board as ground plane, and thereby, by reducing the size of the printed circuit boards, also the ground plane for the hearing aid antennas is reduced. Thereby, the efficiency of conventional hearing aid antennas needing a good RF ground will be reduced, thus it is a significant advantage of the present antenna that no ground plane is needed for the antenna.

The antenna may form a mirrored inverted F-antenna wherein the first part of the antenna, and substantially half of the segment is a mirror image to the second part of the antenna and substantially the other half of the segment. The width of the antenna may determine the bandwidth for the antenna, thus by increasing the width of the inverted F-antenna, the bandwidth may also be increased.

The first and/or second part of the antenna may form monopole antenna structure(s), such as any antenna structure having a free end, such as a linear monopole antenna structure, etc. The length of the first and/or second part of the antenna as measured from the short circuit to the free end may be substantially lambda/4, or any odd multiple thereof, where lambda is the center wavelength for the antenna.

In one or more embodiments, the first part of the antenna and/or the second part of the antenna may be an antenna structure having a circumference of substantially lambda/2 or any multiple thereof. Thus, the antenna structure may be a circular antenna structure, an annular or ring-shaped antenna structure, or the antenna structure may be any closed antenna structure having a circumference of substantially lambda/2. The closed structure may be a solid structure, a strip like structure having an opening in the center, etc. and/or the closed structure may have any shape and be configured so that the current sees a length of lambda/2.

In one or more embodiments, the first and or second part of the antenna may extend in a plane being substantially parallel to a side of the head when the hearing aid is worn in its operational position by a user. The first and/or second part of the antenna may be planar antennas extending only in the plane being substantially parallel to a side of the head, or the first and/or second part of the antenna may primarily extend in the plane being substantially parallel to a side of the head, so that the first and/or second part of the antenna may exhibit e.g. minor, as compared to the overall extent of the antenna, folds in a direction not parallel to the side of the head.

The area of the first part of the antenna and/or the second side of the antenna may be maximized relative to the size of the hearing aid to for example increase the bandwidth of the antenna. The first and/or second part of the antenna may be a solid structure extending over the entire side of the hearing aid, or at least extending over a large part of the side of the hearing aid, furthermore, the circumference of the first and/or second part of the antenna may be maximized allowing for an opening in the structure to accommodate e.g. a hearing aid battery, electronic components, or the like.

The first and/or second part of the antenna may form part of a hearing aid housing encompassing at least a part of the hearing aid.

The first and/or second part of the antenna may form a first resonant structure and a second resonant structure, respectively.

The current flowing in a resonant antenna structure forms standing waves along the length of the antenna; and for proper operation, the resonant antenna structure is operated at, or approximately at, a resonance frequency at which the length of the linear antenna equals a quarter wavelength of the emitted electromagnetic field, or any odd multiple, thereof.

The first and second resonant structures may be resonant around a center frequency, i.e. around the resonance frequency for the antenna, and typically, the resonant antenna structure may be resonant within a given bandwidth around the center frequency.

The first resonant structure and/or the second resonant structure may be actively fed resonant structures. In the present context, the term actively fed resonant structure encompasses that the resonant structure is electrically connected to a source, such as a radio, such as a transceiver, a receiver, a transmitter, etc. Thus, the first and second resonant structures may be driven structures, such as driven resonant structure, such as a driven resonant antenna structure. Thus, the actively fed resonant structure is opposed to the passive antenna structure which is not electrically connected to the surroundings. The first resonant structure and the second resonant structure may in some embodiments be fed symmetrically.

In one or more embodiments, the antenna may further comprise a feed system for exciting the antenna to thereby induce a current in at least the conducting segment, wherein the feed system may be configured such that the current has a first local maxima proximate the first side of the hearing aid and a second local maxima proximate the second side of the hearing aid along the conducting segment. Thus, the current induced on the antenna may reach its maximum on the segment of the antenna that extends from proximate the first side of the hearing aid to proximate the second side of the hearing aid.

The current induced in the segment may have a first local maximum proximate the first side of the hearing aid and a second local maximum proximate the second side of the hearing aid, depending on the excitation of the antenna.

The feed system may comprise the first feed point for exciting the first antenna structure and the second feed point for exciting the second antenna structure. The feed system may furthermore comprise one or more transmission lines for connecting the first and second parts of the antenna to the source, e.g. to the transceiver. The first feed point may reflect the connection between a first transmission line and the first part of the antenna, and the second feed point may reflect the connection between another transmission line and the second part of the antenna.

In one or more embodiments, the first feed point and the second feed point, respectively, are configured with respect to the short circuit so as to obtain a desired antenna impedance. Typically, a distance between the first feed point and the short circuit along the first resonant structure may be configured to achieve the desired impedance, and likewise, a distance between the second feed point and the short circuit along the second resonant structure may be configured to achieve the desired impedance.

It is envisaged that the overall physical length of the antenna may be decreased by interconnecting the antenna with an electronic component, a so-called antenna shortening component, having an impedance that modifies the standing wave pattern of the antenna thereby changing its effective length. The required physical length of the antenna may for example be shortened by connecting the antenna in series with an inductor or in shunt with a capacitor.

The antenna may be configured for operation in the ISM frequency band. Preferably, the antenna is configured for operation at a frequency of at least 1 GHz, such as at a frequency between 1.5 GHz and 3 GHz such as at a frequency of 2.4 GHz.

In the above, the embodiments have been described primarily with reference to a hearing aid, such as a behind the ear hearing aid or such as a binaural hearing aid. It is however envisaged that the disclosed features and embodiments may be used in combination with any aspect described herein.

The above and other features and advantages will become more apparent to those of ordinary skill in the art by describing in detail exemplary embodiments thereof with reference to the attached drawings in which:

The current flowing in a resonant antenna structure forms standing waves along the length of the antenna; and for proper operation, the resonant antenna structure is operated at, or approximately at, a resonance frequency at which the length of the linear antenna equals a quarter wavelength of the emitted electromagnetic field, or any odd multiple, thereof.

A behind the ear (BTE) hearing aid includes: a microphone for reception of sound and conversion of the received sound into a corresponding first audio signal; a signal processor for processing the first audio signal into a second audio signal compensating a hearing loss of a user of the hearing aid; a receiver coupled (e.g., directly coupled or indirectly coupled) to an output of the signal processor for converting the second audio signal into an output sound signal; a partition plane extending between a first side of the hearing aid and a second side of the hearing aid; and a transceiver for wireless data communication interconnected with an antenna for electromagnetic field emission and electromagnetic field reception, the antenna having a first feed point and a second feed point; wherein at least a part of the antenna intersects the partition plane at an intersection so that a relative difference between a first distance from the first feed point to the intersection and a second distance from the second feed point to the intersection is less than or equal a first threshold. The signal processor may be any component or any combination of components that is capable of performing signal processing. For examples, the signal processor may be an ASIC processor, a FPGA processor, a general purpose processor, a microprocessor, a circuit component, or an integrated circuit.

Optionally, the first distance is a shortest distance between the first feed point and the partition plane, and the second distance is a shortest distance between the second feed point and the partition plane.

Optionally, the first threshold is less than 25%.

Optionally, the first threshold is substantially 0 (e.g., 0±0.1).

Optionally, the partition plane comprises a symmetry plane for the antenna.

Optionally, the partition plane extends substantially parallel to a surface of a head of the user when the hearing aid is worn in its operational position by the user.

Optionally, a first part of the antenna is located proximate the first side of the hearing aid and a second part of the antenna is located proximate the second side of the hearing aid.

Optionally, the first part of the antenna and/or the second part of the antenna extends in a plane being substantially parallel to a side of a head of the user when the hearing aid is worn in its operational position by the user.

Optionally, the first part of the antenna and/or the second part of the antenna comprises a resonant antenna structure.

Optionally, a segment of the antenna intersects the partition plane and short circuits the first part of the antenna and the second part of the antenna to form a current bridge.

Optionally, the segment has a direction substantially orthogonal to a head of the user when the hearing aid is worn in its operational position by the user.

Optionally, a distance between the first feed point and a short circuit, and a distance between the second feed point and the short circuit, are configured to achieve a desired antenna impedance.

Optionally, the first part of the antenna and the second part of the antenna are substantially identical. For example, the first part and the second part may have respective corresponding dimensions that differ by less than 10%.

Optionally, the first part of the antenna and/or the second part of the antenna comprises a monopole antenna structure.

Optionally, a length of the first part of the antenna and/or a second part of the antenna as measured from a short circuit to a free end of the antenna is substantially lambda/4.

Optionally, the first part of the antenna and/or the second part of the antenna comprises an antenna structure having a circumference of lambda/2.

Optionally, the antenna structure is a circular antenna structure.

Optionally, an area of the antenna is maximized relative to a size of the hearing aid.

Optionally, at least a part of the antenna forms a part of a hearing aid housing.

Optionally, the antenna is a balanced antenna.

Other and further aspects and features will be evident from reading the following detailed description.

BRIEF DESCRIPTION OF THE DRAWINGS

The drawings illustrate the design and utility of embodiments, in which similar elements are referred to by common reference numerals. These drawings may or may not be drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

DETAILED DESCRIPTION

Figure 1:
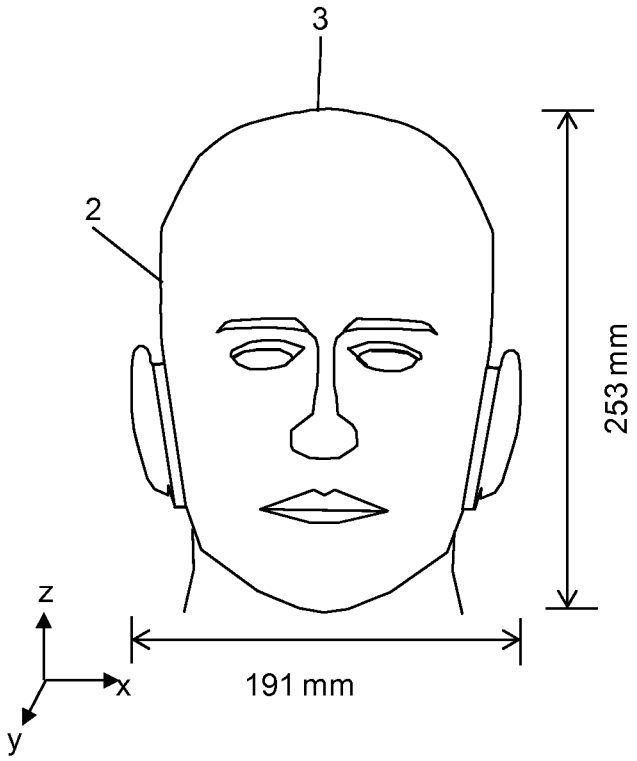
FIG. 1 is a phantom head model of a user together with an ordinary rectangular three dimensional coordinate system with an x, y and z axis for defining the geometrical anatomy of the head of the user.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. The claimed invention may be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The radiation pattern of an antenna is typically illustrated by polar plots of radiated power in horizontal and vertical planes in the far field of the antenna. The plotted variable may be the field strength, the power per unit solid angle, or directive gain. The peak radiation occurs in the direction of maximum gain.

FIG. 1 is a phantom head model of a user seen from the front together with the ordinary rectangular three dimensional coordinate system.

When designing antennas for wireless communication proximate the human body, the human head can be approximated by a rounded enclosure with sensory organs, such as the nose, ears, mouth and eyes attached thereto. Such a rounded enclosure 3 is illustrated in FIG. 1. In FIG. 1, the phantom head model is shown from the front together with an ordinary rectangular three dimensional coordinate system with an x, y and z axis for defining orientations with relation to the head and for defining the geometrical anatomy of the head of the user;

Every point of the surface of the head has a normal and tangential vector. The normal vector is orthogonal to the surface of the head while the tangential vector is parallel to the surface of the head. An element extending along the surface of the head is said to be parallel to the surface of the head, likewise a plane extending along the surface of the is said to be parallel to the surface of the head, while an object or a plane extending from a point on the surface of the head and radially outward from the head into the surrounding space is said to be orthogonal to the head.

As an example, the point with reference numeral 2 in FIG. 1 furthest to the left on the surface of the head in FIG. 1 has tangential vectors parallel to the yz-plane of the coordinate system, and a normal vector parallel to the x-axis. Thus, the y-axis and z-axis are parallel to the surface of the head at the point 2 and the x-axis is orthogonal to the surface of the head at the point 2.

The user modeled with the phantom head of FIG. 1 is standing erect on the ground (not shown in the figure), and the ground plane is parallel to xy-plane. The torso axis from top to toe of the user is thus parallel to the z-axis, whereas the nose of the user is pointing out of the paper along the y-axis.

The axis going through the right ear canal and the left ear canal is parallel to the x-axis in the figure. This ear to ear axis (ear axis) is thus orthogonal to the surface of the head at the points where it leaves the surface of the head. The ear to ear axis as well as the surface of the head will in the following be used as reference when describing specific configurations of the elements of one or more embodiments.

Since the auricle of the ear is primarily located in the plane parallel to the surface of the head on most test persons, it is often described that the ear to ear axis also functions as the normal to the ear. Even though there will be variations from person to person as to how the plane of the auricle is oriented.

The in the ear canal type of hearing aid will have an elongated housing shaped to fit in the ear canal. The longitudinal axis of this type of hearing aid is then parallel to the ear axis, whereas the face plate of the in the ear type of hearing aid will typically be in a plane orthogonal to the ear axis. The behind the ear type of hearing aid will typically also have an elongated housing most often shaped as a banana to rest on top of the auricle of the ear. The housing of this type of hearing aid will thus have a longitudinal axis parallel to the surface of the head of the user.

Figure 2:
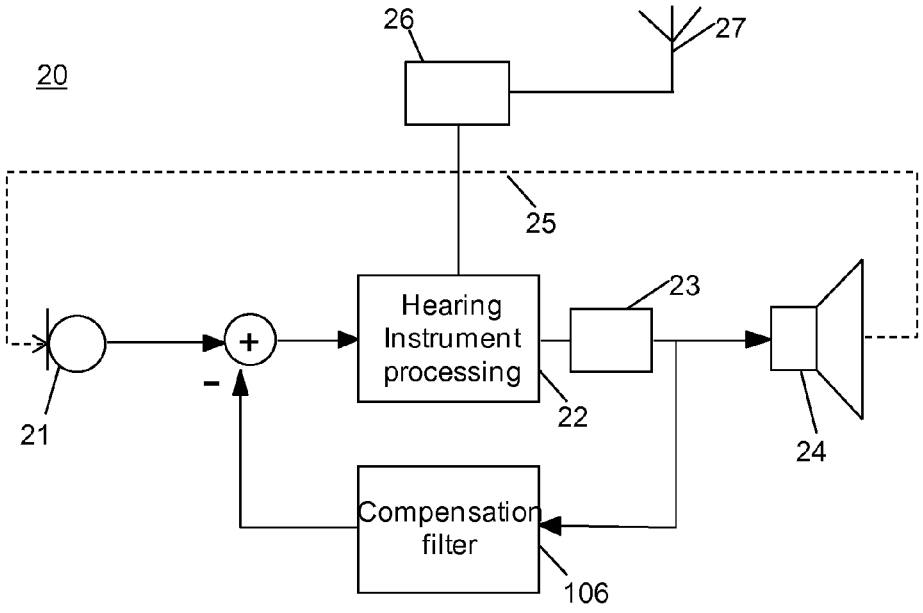
FIG. 2 shows a block-diagram of a typical hearing aid.

A block-diagram of a typical (prior-art) hearing instrument is shown in FIG. 2. The hearing aid 20 comprises a microphone 21 for receiving incoming sound and converting it into an audio signal, i.e. a first audio signal. The first audio signal is provided to a signal processor 22 for processing the first audio signal into a second audio signal compensating a hearing loss of a user of the hearing aid. A receiver 23 is connected to an output of the signal processor 22 for converting the second audio signal into an output sound signal, e.g. a signal modified to compensate for a users hearing impairment, and provides the output sound to a speaker 24. Thus, the hearing instrument signal processor 22 may comprise elements such as amplifiers, compressors and noise reduction systems etc. The hearing instrument or hearing aid may further have a feedback loop 25 for optimizing the output signal. The hearing aid may furthermore have a transceiver 26 for wireless data communication interconnected with an antenna 27 for emission and reception of an electromagnetic field. The transceiver 26 may connect to the hearing instrument processor 22 and an antenna, for communicating with external devices, or with another hearing aid, located at another ear, in a binaural hearing aid system.

However, also other embodiments of the antenna and the antenna configurations may be contemplated.

The specific wavelength, and thus the frequency of the emitted electromagnetic field, is of importance when considering communication involving an obstacle. In one or more embodiments, the obstacle is a head with a hearing aid comprising an antenna located closed to the surface of the head. If the wavelength is too long such as a frequency of 1 GHz and down to lower frequencies greater parts of the head will be located in the near field region. This results in a different diffraction making it more difficult for the electromagnetic field to travel around the head. If on the other hand the wavelength is too short, the head will appear as being too large an obstacle which also makes it difficult for electromagnetic waves to travel around the head. An optimum between long and short wavelengths is therefore preferred. In general the ear to ear communication is to be done in the band for industry, science and medical with a desired frequency centred around 2.4 GHz.

It is envisaged that even though only a behind-the-ear hearing aid have been shown in the figures, the described antenna structure may be equally applied in all other types of hearing aids, including in-the-ear hearing aids, as long as the conducting segment is configured to guide the current in a direction parallel to an ear-to-ear axis of a user, when the user is wearing the hearing aid in the operational position and furthermore, equally applied to other body wearable devices, as long as the conducting segment is configured to guide the current in a direction orthogonal to a surface of the body, when the user is wearing the hearing aid in the operational position.

In general, various sections of the antenna can be formed with many different geometries, they can be wires or patches, bend or straight, long or short as long as they obey the above relative configuration with respect to each other such that at least one conducting segment will carry a current being primarily parallel to the ear axis (orthogonal to the surface of the head 1 of the user at a point 2 in proximity to the ear) such that the field will be radiated in the desired direction and with the desired polarization such that no attenuation is experienced by the surface wave travelling around the head.

The specific wavelength, and thus the frequency of the emitted electromagnetic field, is of importance when considering communication involving an obstacle. In one or more embodiments, the obstacle is a head with a hearing aid comprising an antenna located closed to the surface of the head. If the wavelength is too long such as a frequency of 1 GHz and down to lower frequencies greater parts of the head will be located in the near field region. This results in a different diffraction making it more difficult for the electromagnetic field to travel around the head. If on the opposite side the wavelength is too short the head will appear as being too large an obstacle which also makes it difficult for electromagnetic waves to travel around the head. An optimum between long and short wavelengths is therefore preferred. In general the ear to ear communication is to be done in the band for industry, science and medical with a desired frequency centred around 2.4 GHz.

Figure 3:
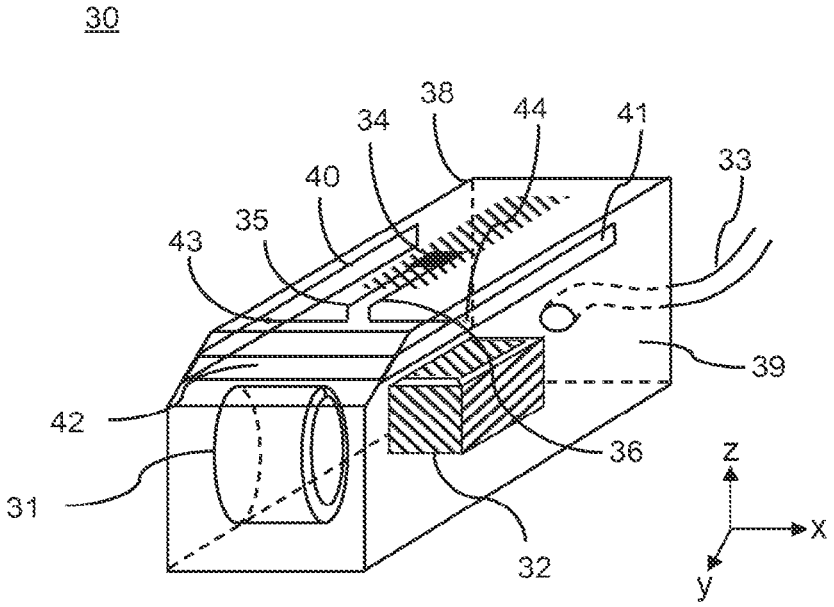
FIG. 3 shows a behind the ear hearing aid having an antenna according to one embodiment.

In FIG. 3, a hearing aid 30 is shown schematically, the hearing aid 30 is a hearing aid of the type to be worn behind the ear, typically referred to as a behind the ear hearing aid, or a BTE hearing aid. The hearing aid 30 comprises a battery 31, a signal processor 32, a sound tube 33 connecting to the inner ear, a radio or transceiver 34, transmission lines 35, 36 for feeding the antenna 37. The hearing aid has a first side 38 and a second side 39 and a first part 40 extend along the first side 38 of the hearing aid, and a second part of the antenna 41 extend along a second side 39 of the hearing aid 30. The first part of the antenna 40 may in one or more embodiments be a first resonant structure provided proximate the first side 38 of the hearing aid, and the second part of the antenna 41 may in one or more embodiments be a second resonant structure provided proximate a second side 39 of the hearing aid. A conducting segment 42 short circuits the first part 40 and the second part 41 to provide a current bridge between the first side of the hearing aid and the second side of the hearing aid. The first part 40 is fed via transmission line 35 to feed point 43 and is thus an actively fed part 40. The second part 41 is fed via transmission line 36 to feed point 44 and thus forms a second actively fed part 41.

Figure 4:
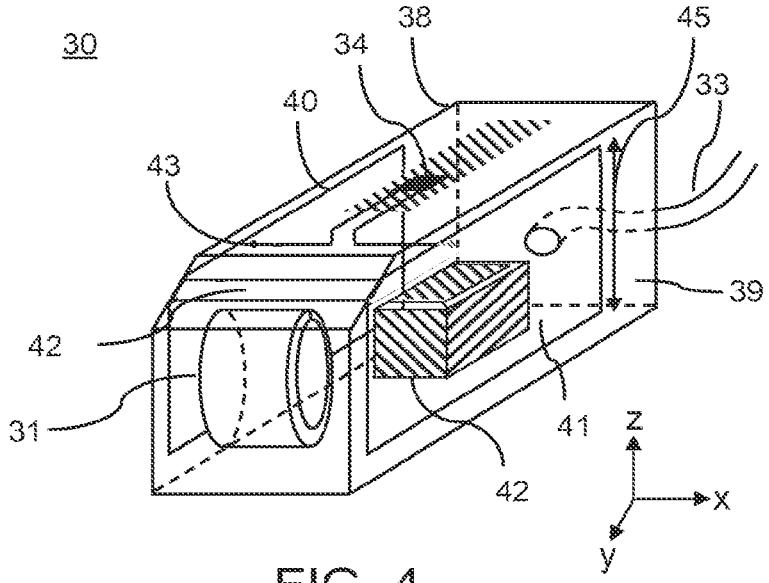
FIG. 4 shows a behind the ear hearing aid having an antenna according to another embodiment.

In FIG. 4, a hearing aid 30 is shown schematically, wherein the width 45 of the first part 40 of the antenna 37 and the second part 41 of the antenna 37 is increased to increase the bandwidth of the antenna 37.

Figure 5:
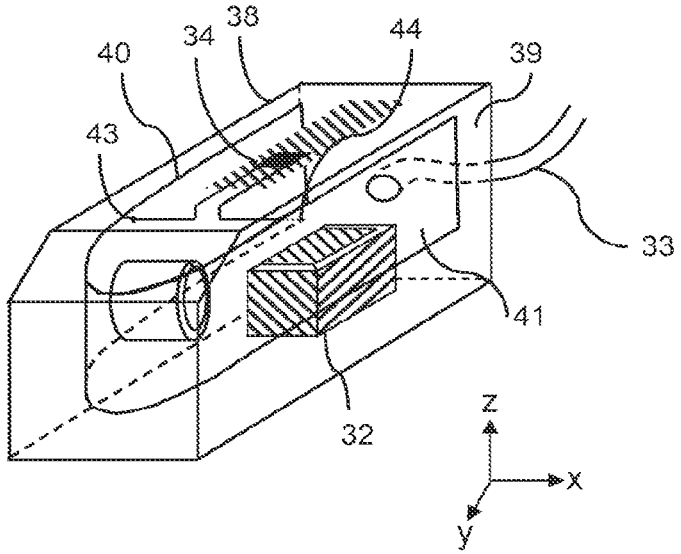
FIG. 5 shows a behind the ear hearing aid having an antenna according to a further embodiment.

In FIG. 5, a hearing aid 30 is shown schematically, wherein the antenna 37 is folded around the hearing aid 30, and thus the antenna extends along the first side 38 and the second side 39.

Figure 6:
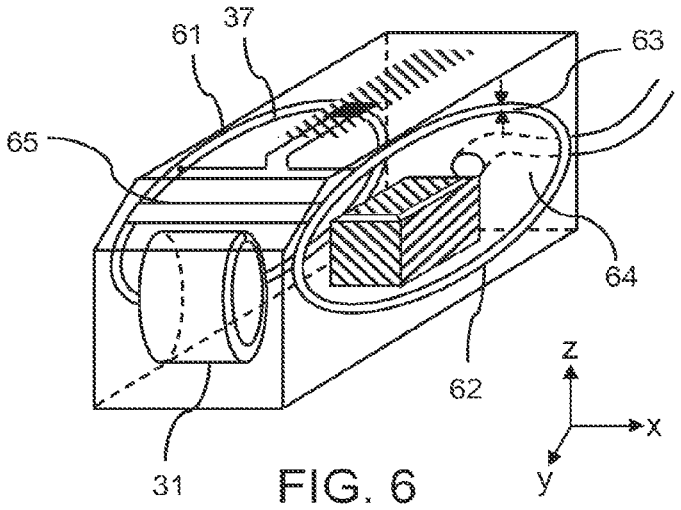
FIG. 6 shows a behind the ear hearing aid having an antenna according to a still further embodiment.

FIG. 6 shows a further embodiment, wherein the hearing aid 30 has an antenna 37 having a first part 61 and a second part 62. The first part 61 and/or second part 62 are closed antennas having a width 63 allowing for an opening 64 to be formed within the antenna 37. The opening may allow for configuring the antenna so as not to extend over battery 31 and other larger electrical components. The first part 61 and/or the second part 62 may have any width and/or any shape configured according to hearing aid restrictions and/or antenna optimization. For the first part 61 and/or the second part 62 to be resonant structures, the circumference of the first and/or second parts 61, 62 is approximate lambda/2, where lambda is the resonance wavelength for the antenna 37. The conducting segment 65 short circuits the first part 61 and the second part 62 thereby creating a current bridge along the conducting segment 65. It is seen that the current bridge forms an elongated structure, and is positioned so that the elongated structure has a direction substantially orthogonal to the surface of the head, that is substantially parallel to an ear-to-ear axis of a user when the hearing aid is positioned in its operational position behind the ear of a user.

Figure 7:
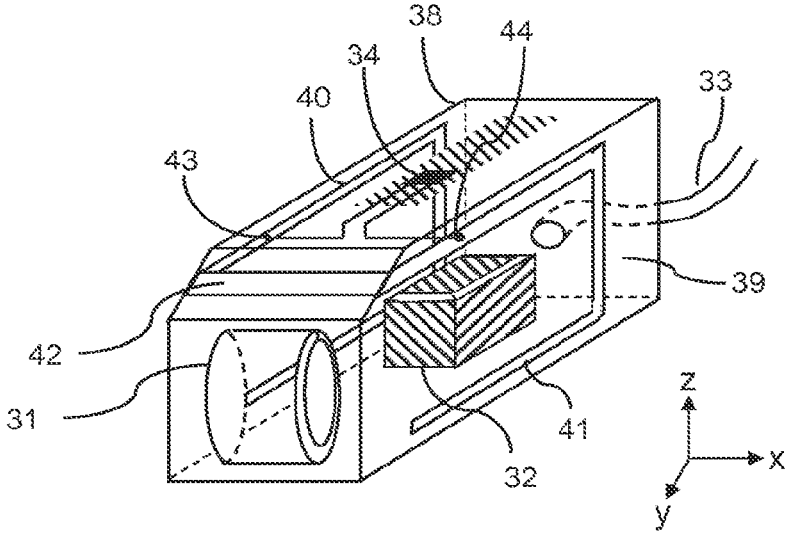
FIG. 7 shows a behind the ear hearing aid having an antenna according to a another embodiment.

FIG. 7 shows a further shape of the antenna 37, wherein the first part 38 and the second part 39 has a meander form of the antenna.

It is envisaged that even though the conducting segment in FIGS. 3-7 is shown as being orthogonal to the surface of the head, also other configurations may be applied, so that the conducting segments forms a non-perpendicular angle with the surface of the head, such as an angle of between 90° and 45°, such as between 90° and 80°. Hereby, the current will show at least a current component in the direction being orthogonal to the surface of the head. Furthermore, even though the first part 38, 61 and the second part 39, 62 are shown to be identical in FIGS. 3-7, it is envisaged that the shapes of the first part 38, 61 and the second parts 39, 62 may differ.

In FIGS. 8*a-e*, schematic antennas 80 are shown, illustrating the feed points 83, 84 and the length of the first and second parts 38, 39, 61, 62 and the distances δ between the feed points 83, 84 and the short circuit.

Figure 8A:
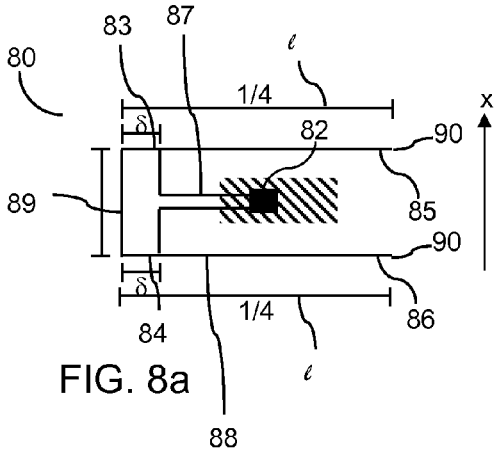
FIGS. 8*a*-8*e* show schematically the feed and the short circuit for different embodiments.

In FIG. 8*a*, an antenna 80 is shown. The antenna has a first part 85 and a second part 86 and a transceiver 82 located between the first side and the second side. First transmission line 87 feeds the first part 85 in a feed point 83 and second transmission line 88 feeds the second part 86 in a feed point 84. The conducting segment 89 extends from the first part 85 to the second part 86 and short circuits the first and second parts 85, 86. In that the antenna is balanced, the current in the short circuit will be maximized. The distance δ along the first part 85 between the first feed point 83 and the short circuit 89 is tailored to the desired impedance for the antenna, and the length l of the first part 85 is measured from the short circuit 89 to the free end of the antenna 90 and is lambda/4 in order for the first part to form a resonant antenna structure. Likewise the distance δ along the second part 86 between the second feed point 84 and the short circuit 89 is tailored to the desired impedance for the antenna, and the length l of the second part 86 is measured from the short circuit 89 to the free end of the antenna 91 and is lambda/4 in order for the second part to form a first resonant structure. The first resonant structure 85 is actively fed in the feed point 83 and second resonant structure 86 is actively fed in the feed point 84.

Figure 8B:
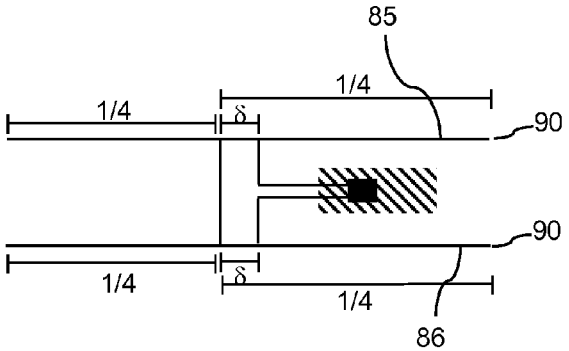

FIG. 8*b* shows another embodiment, in which the first and second parts 85, 86 extends a length of lambda/4 on both sides of the short circuit.

Figure 8C:
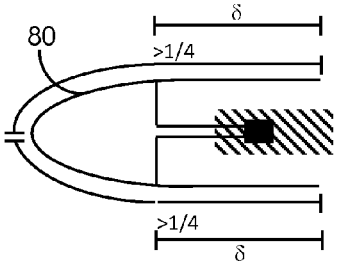

FIG. 8*c* shows a further embodiment, in which the antenna 80 extends around the sides of the hearing aid. The length of the sides is larger than lambda/4.

Figure 8D:
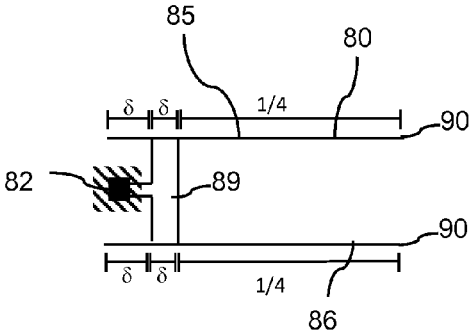

FIG. 8*d* shows a further embodiment in which the short circuit 89 is provided on another side of the transceiver 82. Thus, the length of the first part 85 is measured from the short circuit 89 to the free end 90, and is lambda/4 to form a first resonant structure. Likewise, the length of the second part 86 is measured from the short circuit 89 to the free end 90, and is lambda/4 to form a second resonant structure. The antenna 80 may extend beyond the feed points 83, 84, however, the length of this extension is typically minimized.

Figure 8E:
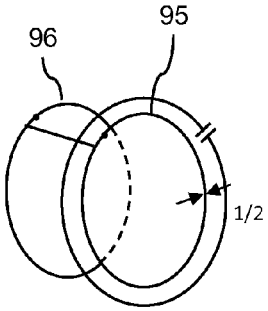

FIG. 8*e* shows an embodiment having a closed antenna structure 80 having a first part 95 and a second part 96. The length of the first and second closed part is lambda/2 to obtain a resonant structure. The widths of the first part 95 and the second part 96 may be tailored according to a desired antenna impedance.

Figure 9A:
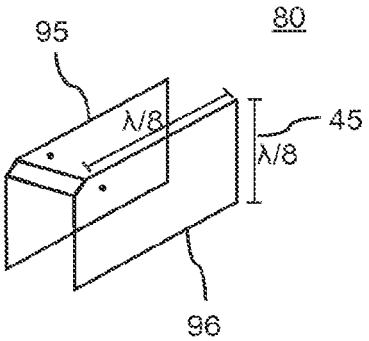
FIGS. 9*a-b* show schematically the length of the current path on an antenna.
Figure 9B:
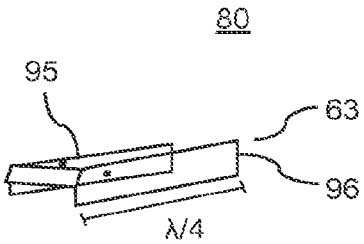

FIGS. 9*a-b* show how the length of the antenna may be measured along the current path in the first and second parts. In FIG. 9*a*, the first part is a wide antenna structure, and the length along a top part is lambda/8 and the length along a side part is lambda/8, thus having a total length along the current path of lambda/4.

FIG. 9*b* shows an example of thinner first and second parts, wherein the length of the first part along the current path is lambda/4.

Figure 10A:
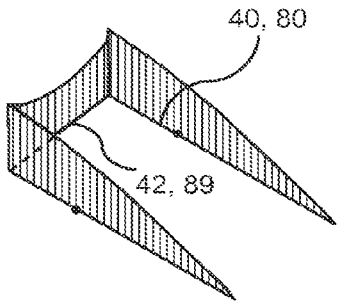
FIGS. 10*a-d* show schematically the current distribution along an antenna.
Figure 10B:
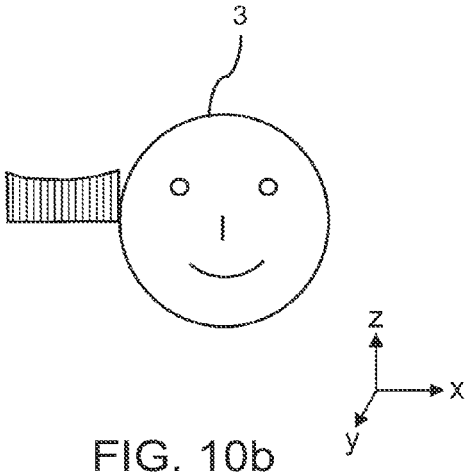
Figure 10C:
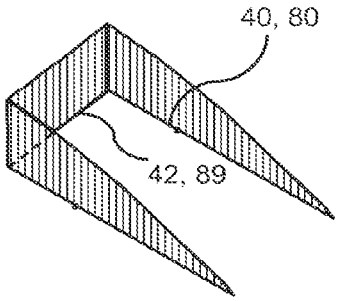
Figure 10D:
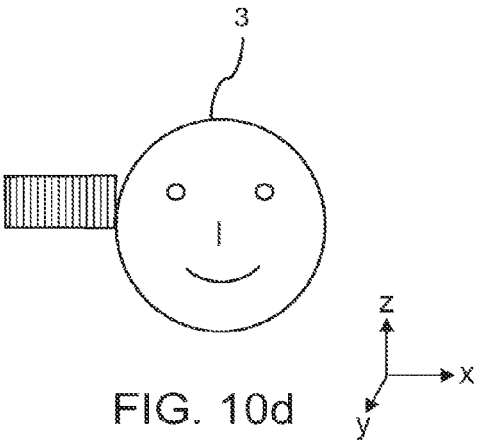

FIGS. 10*a-d* shows the current along an antenna 40, 80. The current is seen to be zero at the free ends 90 of the antenna. It is furthermore seen that the maximum current is found along the segment or the conducting segment 42, 89. As seen in FIG. 10*a*, showing a wide BTE hearing aid, that is a relatively long current bridge or segment, the current exhibits two local maxima at each side of the short circuit with a slight decrease towards the middle. If the BTE hearing aid is a narrow hearing aid, the current may as shown in FIG. 10*c*, be substantially constantly high across the short circuit or the segment. Thus, as is seen from FIGS. 10*b* and 10*d*, the current is maximized in a direction being substantially orthogonal to the side of the head.

The segment, or the conducting segment may have a have a length being between at least one sixteenth wavelength and a full wavelength of the electromagnetic field.

Figure 11A:
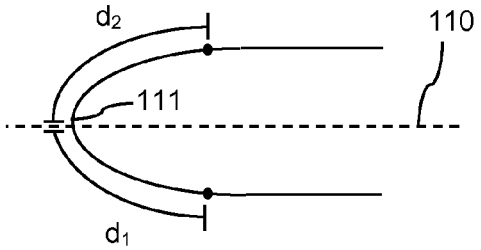
FIGS. 11*a-d* show schematically a partition plane for different antenna structures.
Figure 11B:
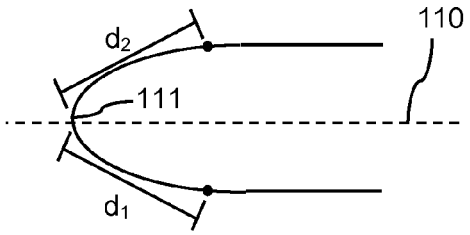
Figure 11C:
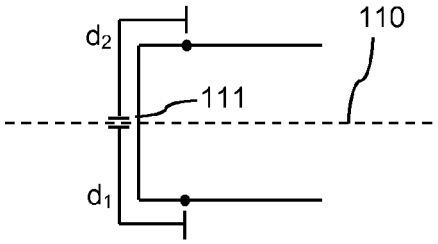
Figure 11D:
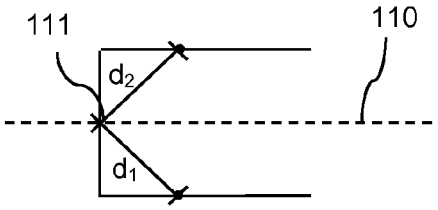

FIGS. 11*a-d* show different embodiments of a partition plane 110 partitioning the antenna 80. The antenna 80 is seen to intersect the partition plane 110 at an intersection 111, thus, the antenna may intersect at least at a point 111, or along an axis of the antenna extending through the plane 110. The distances d1, d2 from the feed points 83, 84, to the intersection 111, respectively may be measured along the current path as shown in FIGS. 11*a* and 11*c*, or the distances d1 and d2 may be measured along the shortest distance from the feed points 83, 84, to the intersection 111.

The partition plane 110 may be a symmetry plane 110 for the antenna so that the first part 85 of the antenna is symmetric with the second part 86 of the antenna with respect to the symmetry plane 110. The partition plane 110 may extend exactly mid through the hearing aid, or the partition plane may extend anywhere between a first side of the hearing aid and a second side of the hearing aid. In one or more embodiments, the partition plane extends through the receiver.

It should be noted that as used in this specification, the term "substantially" refers to a value variation that is within plus or minus 10%. For example, the term "substantially parallel" and similar terms refer to an angle that is 0 (or 180 degrees) ±18 degrees. Similarly, the term "substantially orthogonal" and similar terms refer to angle that is 90±9 degrees. Also, the term "substantially lambda/4" refers to lambda/4±lambda/40.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

a behind-the-ear (BTE) housing;

a microphone for reception of sound and conversion of the received sound into a corresponding first audio signal;

a signal processor for processing the first audio signal into a second audio signal compensating a hearing loss of a user of the hearing aid, the signal processor located in the BTE housing;

a receiver coupled to an output of the signal processor for converting the second audio signal into an output sound signal;

an antenna; and a communication device for wireless data communication, the communication device being interconnected with the antenna;

wherein the antenna has a first part extending in a first plane that is closer to a first side of the hearing aid than to a second side of the hearing aid, and a second part extending in a second plane that is closer to a second side of the hearing aid than to the first side of the hearing aid, the second side being opposite from the first side, the first plane and the second plane being offset relative to each other; and wherein the antenna has a first connection connecting the first part to a first conductor, and a second connection connecting the second part to a second conductor, the first connection being closer to the first side than to the second side of the hearing aid, the second connection being closer to the second side than to the first side of the hearing aid.

2. The hearing aid according to claim 1, wherein the antenna further comprises a segment between the first part and the second part, and wherein a relative difference between a first distance from the first connection to a midpoint of the segment, and a second distance from the second connection to the midpoint of the segment, is less than or equal to a first threshold.

3. The hearing aid according to claim 2, wherein the first distance is a shortest distance between the first connection and the midpoint of the segment, and the second distance is a shortest distance between the second connection and the midpoint of the segment.

4. The hearing aid according to claim 2, wherein the first threshold is less than 25%.

5. The hearing aid according to claim 2, wherein the first threshold is substantially 0.

6. The hearing aid according to claim 1, further comprising a partition plane, wherein the partition plane comprises an imaginary symmetry plane for the antenna.

7. The hearing aid according to claim 6, wherein the partition plane extends substantially parallel to a surface of a head of the user when the hearing aid is worn in its operational position by the user.

8. The hearing aid according to claim 1, wherein the first part of the antenna and/or the second part of the antenna extends in a plane being substantially parallel to a side of a head of the user when the hearing aid is worn in its operational position by the user.

9. The hearing aid according to claim 1, wherein the first part of the antenna and/or the second part of the antenna comprises a resonant antenna structure.

10. The hearing aid according to claim 1, wherein the antenna further includes a segment that short circuits the first part of the antenna and the second part of the antenna to form a current bridge.

11. The hearing aid according to claim 10, wherein the antenna further includes a segment between the first part and the second part, wherein the segment has a direction substantially orthogonal to a head of the user when the hearing aid is worn in its operational position by the user.

12. The hearing aid according to claim 1, wherein the first part of the antenna and the second part of the antenna are substantially identical.

13. The hearing aid according to claim 1, wherein the first part of the antenna and/or the second part of the antenna comprises a monopole antenna structure.

14. The hearing aid according to claim 1, wherein a length of the first part of the antenna and/or the second part of the antenna as measured from a short circuit to a free end of the antenna is substantially lambda/4.

15. The hearing aid according to claim 1, wherein the first part of the antenna and/or the second part of the antenna comprises an antenna structure having a circumference of lambda/2.

16. The hearing aid according to claim 15, wherein the antenna structure is a circular antenna structure.

17. The hearing aid according to claim 1, wherein an area of the antenna is maximized relative to a size of the hearing aid.

18. The hearing aid according to claim 1, wherein at least a part of the antenna forms a part of the aid housing.

19. The hearing aid according to claim 1, wherein the antenna is a balanced antenna.

20. The hearing aid according to claim 1, wherein the antenna further includes a segment between the first part of the antenna and the second part of the antenna.

21. The hearing aid according to claim 20, wherein the segment has a rectilinear portion.

22. The hearing aid according to claim 20, wherein a distance between the first connection and a midpoint of the segment, and a distance between the second connection and the midpoint of the segment, are equal.

23. The hearing aid according to claim 1, wherein the first part of the antenna comprises a first loop that lies in the first plane, the second part of the antenna comprises a second loop that lies in the second plane.

24. A hearing aid comprising:

a behind-the-ear (BTE) housing;

a microphone for reception of sound and conversion of the received sound into a corresponding first audio signal;

a signal processor for processing the first audio signal into a second audio signal compensating a hearing loss of a user of the hearing aid, the signal processor located in the BTE housing;

a receiver coupled to an output of the signal processor for converting the second audio signal into an output sound signal;

an antenna; and a communication device for wireless data communication, the communication device being interconnected with the antenna;

wherein the antenna has a first part that is closer to a first side of the hearing aid than to a second side of the hearing aid, and a second part that is closer to a second side of the hearing aid than to the first side of the hearing aid, the second side being opposite from the first side;

wherein the antenna has a first connection connecting the first part to a first conductor, and a second connection connecting the second part to a second conductor, the first connection being closer to the first side than to the second side of the hearing aid, the second connection being closer to the second side than to the first side of the hearing aid; and wherein the antenna further includes a segment between the first part and the second part, wherein the segment has a direction substantially orthogonal to a head of the user when the hearing aid is worn in its operational position by the user.

25. The hearing aid according to claim 24, wherein the first part of the antenna and the second part of the antenna are substantially identical.

26. The hearing aid according to claim 24, wherein the first part of the antenna comprises a first monopole antenna structure.

27. The hearing aid according to claim 26, wherein the second part of the antenna comprises a second monopole antenna structure.

28. The hearing aid according to claim 24, wherein at least a part of the antenna forms a part of a hearing aid housing.

29. The hearing aid according to claim 24, wherein the segment has a rectilinear portion.

30. The hearing aid according to claim 24, wherein a distance between the first connection and a midpoint of the segment, and a distance between the second connection and the midpoint of the segment, are equal.

31. A hearing aid comprising:

a behind-the-ear (BTE) housing;

a microphone for reception of sound and conversion of the received sound into a corresponding first audio signal;

a signal processor for processing the first audio signal into a second audio signal compensating a hearing loss of a user of the hearing aid, the signal processor located the BTE housing;

a receiver coupled to an output of the signal processor for converting the second audio signal into an output sound signal;

an antenna; and a communication device for wireless data communication, the communication device being interconnected with the antenna;

wherein the antenna has a first part that is closer to a first side of the hearing aid than to a second side of the hearing aid, and a second part that is closer to a second side of the hearing aid than to the first side of the hearing aid, the second side being opposite from the first side;

wherein the antenna has a first connection connecting the first part to a first conductor, and a second connection connecting the second part to a second conductor, the first connection being closer to the first side than to the second side of the hearing aid, the second connection being closer to the second side than to the first side of the hearing aid; and wherein the first side of the hearing aid has a surface for abutment against a head of the user at a location that is behind an ear of the user.

32. The hearing aid according to claim 31, wherein the antenna further includes a segment between the first part and the second part, wherein the segment extends in a direction that forms a non-zero angle with respect to the surface.

33. The hearing aid according to claim 32, wherein the segment has a rectilinear portion.

34. The hearing aid according to claim 32, wherein a distance between the first connection and a midpoint of the segment, and a distance between the second connection and the midpoint of the segment, are equal.

35. The hearing aid according to claim 31, wherein the first part of the antenna and the second part of the antenna are substantially identical.

36. The hearing aid according to claim 31, wherein the first part of the antenna comprises a first monopole antenna structure.

37. The hearing aid according to claim 36, wherein the second part of the antenna comprises a second monopole antenna structure.

38. The hearing aid according to claim 31, wherein at least a part of the antenna forms a part of a hearing aid housing.

* * * * *